United States Patent [19]

Kosler et al.

[11] Patent Number: 4,839,638

[45] Date of Patent: Jun. 13, 1989

[54] PROGRAMMABLE CIRCUIT FOR CONTROLLING A LIQUID CRYSTAL DISPLAY

[75] Inventors: Manfred Kosler; Peter Hubski, both of Berlin, Fed. Rep. of Germany

[73] Assignee: Createc Gesellschaft für Elektrotechnik mgH, Berlin, Fed. Rep. of Germany

[21] Appl. No.: 934,396

[22] PCT Filed: Mar. 6, 1986

[86] PCT No.: PCT/DE86/00094

§ 371 Date: Nov. 6, 1986

§ 102(e) Date: Nov. 6, 1986

[87] PCT Pub. No.: WO86/05305

PCT Pub. Date: Sep. 12, 1986

[30] Foreign Application Priority Data

Mar. 6, 1985 [DE] Fed. Rep. of Germany ..... 3508321

[51] Int. Cl.[4] ..... G09G 3/36; G06F 3/147

[52] U.S. Cl. ..... 340/784; 340/799; 340/750

[58] Field of Search ..... 340/750, 799, 721, 784, 340/724, 798

[56] References Cited

U.S. PATENT DOCUMENTS

| | | | |
|---|---|---|---|
| 3,821,730 | 6/1974 | Carey et al. | 340/750 |
| 4,094,000 | 6/1978 | Brudevold | 340/750 |
| 4,199,757 | 4/1980 | Ichimi | 340/750 |
| 4,414,545 | 11/1983 | Sakarada et al. | 340/784 |
| 4,441,105 | 4/1984 | Van Vliet et al. | 340/750 |
| 4,482,970 | 11/1984 | May | 340/799 |
| 4,536,856 | 8/1985 | Hiroishi | 340/784 |
| 4,554,538 | 11/1985 | Bienemau | 340/799 |
| 4,591,850 | 5/1986 | Lundstrom | 340/799 |

FOREIGN PATENT DOCUMENTS 2509897 2/1983 France .

OTHER PUBLICATIONS

"Spotlighting display devices: Dot-matrix LCD Modules Finding New and Varied Applicantions", Journal of Electronic Engineering, vol. No. 20, No. 195, Mar. 1983 Tokyo, Shuichi et al, pp. 93–97.

*Primary Examiner*—Donald J. Yusko
*Assistant Examiner*—Alvin Oberley
*Attorney, Agent, or Firm*—Spencer & Frank

[57] ABSTRACT

Programmable circuit for controlling a liquid crystal display (LCD controller), possibly through the intermediary of driver stages, for two bus structures, one of which serves for the exchange of data with a computer while the other serves for the exchange of data with at least one addressable memory which is associated with the liquid crystal display (LCD), with both bus structures being configured as complete, parallel bus structures composed of address, data and control lines which, when the control circuit is in a given switching state and possibly in response to a corresponding additional signal from the computer, are interconnected in such a manner that data exchange is possible between the memory associated with the liquid crystal display and the computer.

22 Claims, 3 Drawing Sheets

PROGRAMMABLE CIRCUIT FOR CONTROLLING A LIQUID CRYSTAL DISPLAY

BACKGROUND OF THE INVENTION

The invention relates to a control circuit for controlling a liquid crystal display (LCD controller) for two separate bus structures of which one serves for the exchange of data with a computer while the other serves for the exchange of data with at least one addressable memory associated with the liquid crystal display (LCD).

Circuits of this type are known, which make it possible to derive the information-containing signals required to control a liquid crystal display (LCD) module organized in the form of a matrix from a processor system, with the clock pulse and timing control signals for the LCD being generated in the control circuit itself. Most of the characters to be displayed are generated with the aid of memories provided in the control circuit itself which are able, upon an appropriate instruction, to display complete characters on the LCD.

In customary liquid crystal displays with high resolution signal sequences must be produced—corresponding to the matrix-type actuation—which, on the one hand, emit a sequential succession of signal patterns corresponding to image lines and, on the other hand, take care that the characters are newly recorded, for example with the use of the known "two thirds methods", in regular repetition and, additionally, polarity reversals are effected at certain intervals to avoid electrolysis phenomena in the liquid crystal arrangements. Moreover, switching means should be provided, if required, to supply a plurality of the display faces in parallel since the maximum area to be actuated is limited by the repetition intervals to be maintained. The thus generated signals reach the LCD module by way of driver stages.

The drawback is that the prior art control devices for changing the image contents require more or less complicated operations which all have in common that access by the processor to the memory region associated with the LCD is possible only indirectly, after a corresponding request by way of the control circuit, with waiting cycles and similar delays having to be accepted. In other embodiments, the contents of the liquid crystal display can be displayed only indirectly via a memory which itself contains the components required to generate complete characters composed of groups of dots.

SUMMARY OF THE INVENTION

In contrast thereto, it is an object of the invention to substantially simplify a control device of the above-mentioned type, with changes in the contents of the image on the screen taking place as independently as possible from the function cycles of the control circuit without consideration of special time conditions.

The invention is based on the realization that optimum processing, with respect to time, of signals contained in a display memory is possible if the memory region associated with the display is essentially independent of the internal control sequence of the circuit and substantially uninfluenced by the times required to supply the screen with data from the memory. The access times for actuating the LCD module can then always be kept so short that data access from the computer system is not or hardly impaired with respect to time.

The control circuit is thus "quasi transparent" for the connected computer so that a change in the screen (memory) contents can always take place without regard for the cyclic, internal sequences of the control device. The memories for holding the screen contents appear to the processor system as part of the memory regions directly available to it. Actuation is effected by way of a memory oriented address corresponding to the customary addressing of RAM or ROM memory modules. Access to the memory regions "reserved" for the LCD is here made in regular succession by switching off access by the computer for a short time, it being possible, by means of appropriate buffering between computer and screen memory, that this causes no or at most a slight time delay for the processor system.

In this connection, it is of particular significance that changes of picture contents with slight changes in information can be made by direct access to the running image display without this being subjectively noticed by the observer.

For complex changes in the image display, a switch may be made between two or more different, equal priority memory regions which each cover the entire image content. In this case, the change of displays is effected by switching the control circuit "suddenly", while for an intentional successive change of image content by the processor, the control times for the changes of individual display sections can be selected in such a manner that display elements are "built up" consecutively before the eyes of the observer. By calling up two image contents which are linked together by means of mathematical/logical linkages it is possible at any time to produce further image displays which are generated by a combination or other logic association of the display elements of superposed image contents of the two memory regions. This control is made—likewise memory oriented—by registers addressable by the computer and preferably provided within the control circuit, with the contents of these registers being read out and evaluated by the control circuit.

If the timing control for the switching as determined by the internal timing clock pulse of the control circuit is effected in such a manner that the times for which the internal lines of the control circuit are connected with the bus structure for the transmission of data to the liquid crystal display lie in the order of magnitude of, and are preferably less than, the times for transmission of individual data words in the exchange of data with the computer, access to the memory regions associated with the LCD modules is not or at most only occasionally impeded so that the computer is not limited in its access. Preferably, individual data words are read out in succession from the memory to actuate the LCD module, with, in particular, the time of the subsequent parallel to serial conversion giving the computer renewed access time. The timing controls for the computer and the control circuit here operate asynchronously relative to one another.

BRIEF DESCRIPTION OF THE DRAWINGS

Advantageous features of the invention will be described in greater detail below together with a description of the preferred embodiment of the invention with reference to the drawing figures in which.

DESCRIPTION OF THE PREFERRED EMBODIMENT

Figure 1:
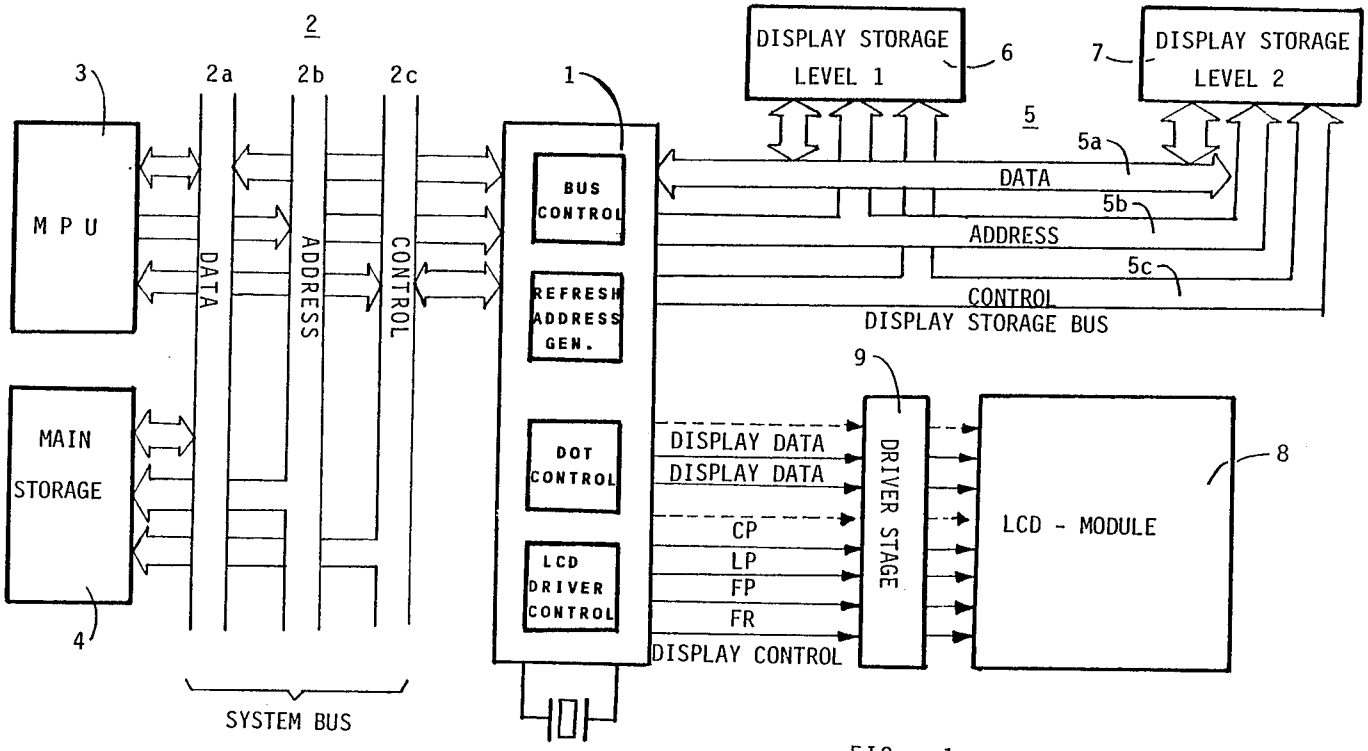
FIG. 1 is a block circuit diagram of the control device according to the invention within a processor system which controls an LCD unit.

In the block circuit diagram shown in FIG. 1, a control circuit 1 is provided between a first, complete bus structure 2 composed of a data bus 2*a*, an address bus 2*b* and a control bus 2*c*. This bus structure forms the system bus which enables data operations between the control circuit according to the invention and a computer 3 as well as a main memory 4 associated with the computer. System bus 2 forms a known bus structure as it is employed in conventional microprocessors.

Control device 1 is connected with a further bus structure 5 which is likewise composed of a data bus 5*a*, an address bus 5*b* and a control bus 5*c*. This second bus structure is connected to a plurality of—two in the present embodiment—addressable memory regions 6, 7 which each contain the complete image content of a graphic information to be displayed on an LCD module. LCD module 8 is controlled by control circuit 1 via a driver stage 9, with the data present in memories 6 and 7, respectively, being converted by the control circuit to serially transmitted information which is adapted to the respective LCD module. In addition to line-by-line transmission of the image contents in cycles required to revitalize the image, polarity reversals and possibly other control pulses are required which are needed to operate such a display module. The data are transmitted by way of two or more lines (display data), with the number of these data lines depending on the number of fields into which the display surface is subdivided.

Figure 2:
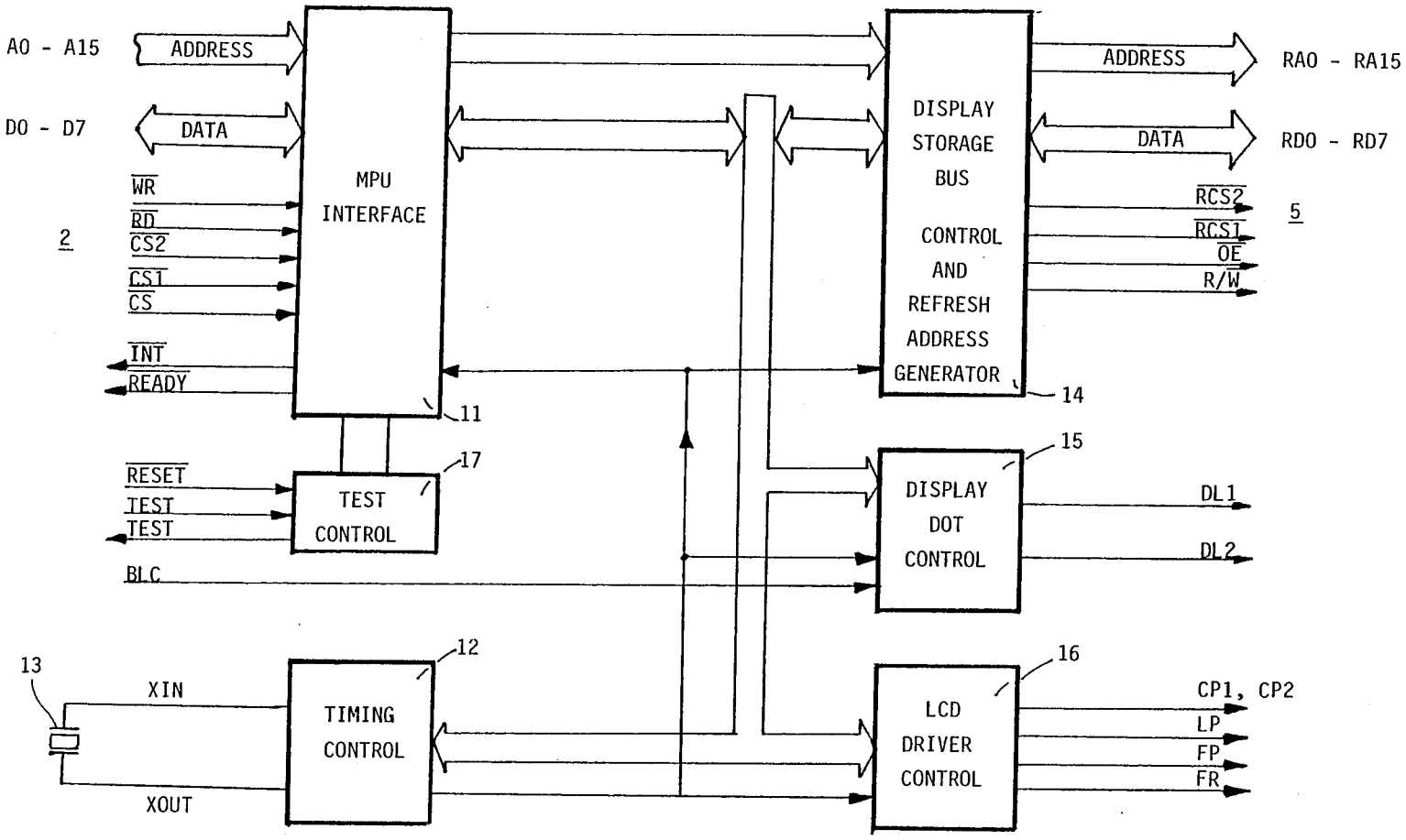
FIG. 2 is a block circuit diagram to explain the internal signal processing for one embodiment of the invention.

In the internal circuitry of control circuit 1 shown in FIG. 2, an interface circuit 11 can be seen in block circuit form which maintains data communications with bus structure 2 and thus constitutes the communications interface with the external computer system.

The block circuit diagram shown in FIG. 2 for the internal circuit also shows the components of the individual control lines (control bus in FIG. 1). The following signal identifications are employed here:

| Name | Function |
|---|---|
| D0–D7 | bidirectional system data bus |
| A0–A15 | system address bus |
| $\overline{CS2}$ | display storage level 2 selection signal, active LOW, selects display RAM 2 for data exchange with the system computer |
| $\overline{CS1}$ | display storage level 1 selection signal, active LOW, selects display RAM 1 for data exchange with the system computer |
| $\overline{CS}$ | circuit selection signal, active LOW, activates the internal address decoder for internal register programming |
| $\overline{WR}$ | write pulse, active LOW |
| $\overline{RD}$ | read pulse, active LOW |
| $\overline{RESET}$ | sets the circuit back without loss of register contents |
| XIN, XOUT | terminals for the internal oscillator, XIN may also be used as external clock pulse input |
| TEST | chip test inputs/outputs |
| RD0–RD7 | bidirectional display storage data bus |
| RA0–RA15 | display storage address bus |
| $\overline{OE}$ | output to enable display storage control signal, active LOW |
| R/$\overline{W}$ | read/write display storage control signal, HIGH = read, LOW = write |
| $\overline{RCS1}$ | selection signal, first display storage |
| $\overline{RCS2}$ | selection signal, second display storage |
| CP1, CP2 | LCD control signal, shift clock pulse |
| LP | LCD control signal, shift cycle end pulse |
| FP | LCD control signal, end of the first shift cycle pulse |
| FR | LCD control siganl for reversing the polarity of the operating voltage for the LCD segments |
| BLC | blink frequency clock pulse input |
| $\overline{INT}$ | interrupt output for the system computer, erasable |
| $\overline{READY}$ | ready signal of the control circuit, LOW = control circuit is ready to exchange data with the system computer |
| DL1, DL2, etc. | data outputs to control the LCD module |

Correspondingly, the above table also provides the identifications and functions of the connections with LCD module 8. A timing control 12 is synchronized by an externally connectable quartz crystal 13. An additional testing device 17 can be actuated externally and transmits, after a properly terminated function test of the module, an acknowledgement output "test" signal. The connections with the external control bus are established by means of a component group 14 which causes the data to be transferred to the second bus structure 5 as shown in FIG. 1.

An actuation module 15 generates the serial data signals to actuate the data lines of the LCD module. The further control pulses for the LCD originate from LCD driver control 16 which generates the signals fed to the external driver circuits.

The control pulses generated by means of driver control 16 can be influenced via internal registers, with the control sequences corresponding to various commercially manufactured LCD modules being represented by different data words.

Figure 3:
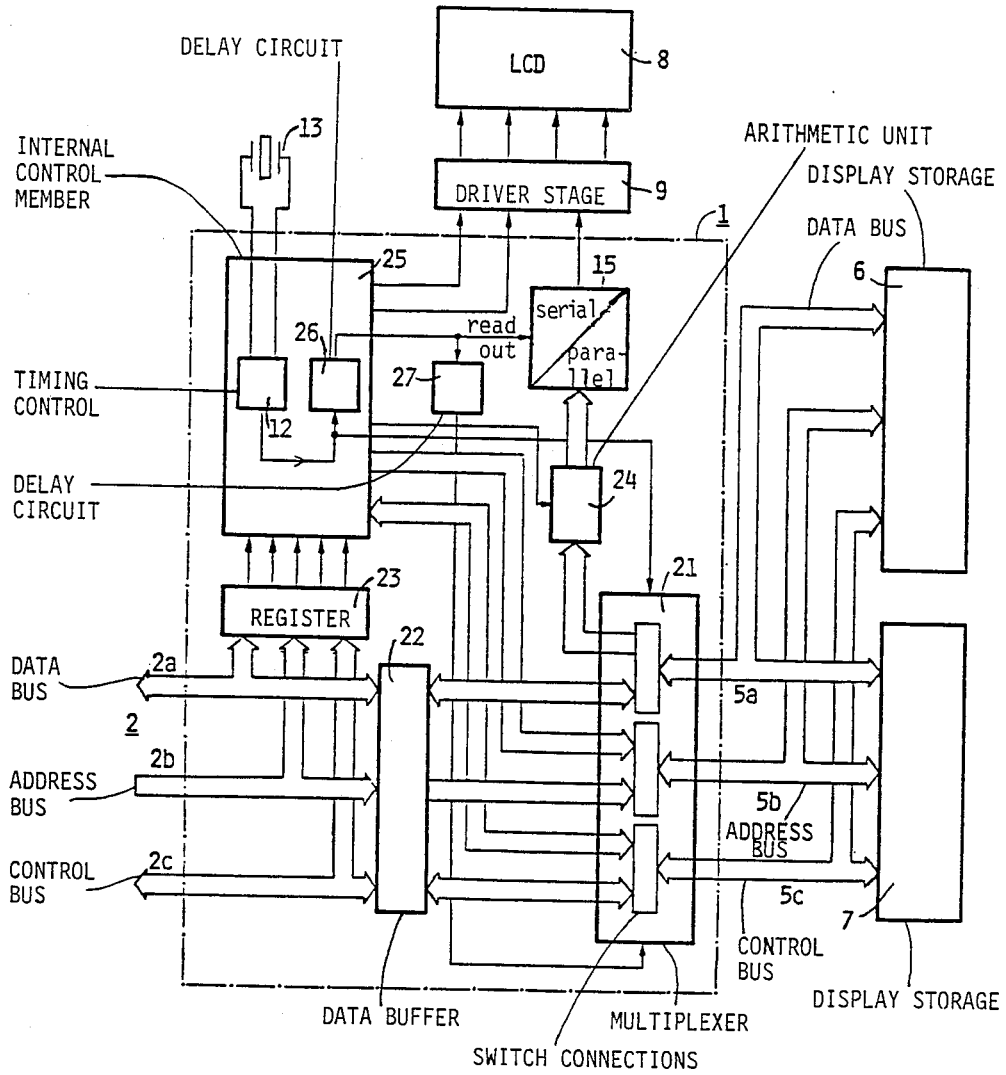
FIG. 3 shows details of the internal circuitry of the embodiment according to FIG. 2.

The illustration according to FIG. 3 shows those components schematically which become functionally active during operation of the control circuit according to the invention. The identification symbols employed for the external component groups correspond to those used in FIGS. 2 and 3, respectively.

A multiplexer 21 which receives the external bus structure 2 (data bus 2*a*, address bus 2*b* and control bus 2*c*) via a data buffer 22 is the central element for linking the two bus structures 2 and 5. By means of switch connections shown as internal blocks, the connection to the external bus structures is influenced for the individual bus lines in dependence on the momentary operating state of control circuit 1. Here, the connection of the bus lines with memory regions 6 and 7 associated with the image display, in principle, has priority over access by the computer via lines 2. Therefore, in the normal case, bus lines 5*a* to 5*c* are reserved for internal access the addressed data into the buffer before the multiplexer again internally assigns bus 5 to the control circuit and, in the write-in mode, the data transferred by the computer are stored and are not written into memory 6 or 7 via the multiplexer until bus 5 is available again to the computer.

This so-called "handshake" operation is here effected with the associated control lines according to agreements customary in the processor art. The use of a data and address buffer in the configuration shown, makes it possible, by increasing the speed of the internal processing of the access of the LCD to the memories compared to the speed of the external computer, to make data processing with the computer slower by about one half than would correspond to the internal clock pulse frequency of the data processing system. With such a timing control and the use of a buffer, the internal operation of the LCD module no longer constitutes any kind of time delay for the computer.

By providing a "ready" line within control bus 2*c*, an external unit receives a ready signal that it may receive or put out data. This state is displayed whenever buffer register 22 has data available or is able to receive data—depending on the direction of transmission. Such a control line makes control unit 1 and the connected memory regions 6 and 7 appear as directly addressable memories. The "ready" signal is put out if in the meantime the buffer register for the address in memory 6 or 7, respectively, also contained in the buffer register, was discharged or if these memories performed a read cycle so that DMA-capable component groups can be controlled in a favorable manner.

The invention is not limited in its embodiments to the preferred embodiment described above. Rather, a number of variations are conceivable which utilize the illustrated solution even for basically differently configured embodiments.

We claim:

1. Programmable control circuit arrangement for controlling a liquid crystal display, comprising:

first and second complete, parallel separate bus structures, each including address, data and control lines, said first bus structure serving for the data exchange of data words with a computer, said second bus structure serving for the exchange of data with at least one addressable memory associated with the liquid crystal display; and a programmable control circuit having internal control line means for interconnecting the liquid crystal display with said second bus structure and pulse producing means for producing an internal clock pulse, and having a first switching state in which said first and second bus structures are interconnected while bypassing said internal control line means, in such a manner that data exchange is possible between the at least one addressable memory and the computer, and a second switching state in which said second bus structure and said internal control line means are interconnected for the transmission of data between the liquid crystal display and the at least one addressable memory and said first and second bus structures are not interconnected in the manner that data exchange is possible between the at least one addressable memory and the computer, said control circuit including means for switching between said first switching state and said second switching state under timing control determined only by said internal time clock pulse.

2. Programmable control circuit arrangement as in claim 1, wherein said switching means comprises means for switching between said first switching state and said second switching state under timing control determined only by said internal time clock pulse such that time segments of continuous connection of said second bus structure to said internal control line means when said control circuit is in the second switching state have lengths of the same order of magnitude as a time required to transmit individual data words during data exchange between the computer and the at least one addressable memory when said control circuit is in the first switching state.

3. Programmable control circuit arrangement according to claim 2, characterized in that various memory regions associated with the liquid crystal display can be reached under identical addresses, with the selection being effected by way of said control lines of said first bus structure.

4. Programmable control circuit arrangement according to claim 1, characterized in that various memory regions associated with the liquid crystal display can be logically linked by means of data words that can be stored in a register; storage of the corresponding data word indicating this state causing the individual display dots to be displayed corresponding to the result of the logic linkage of the memory contents of corresponding display dots.

5. Programmable control circuit arrangement according to claim 1, characterized in that various memory regions associated with the liquid crystal display can be addressed separately by means of data words that can be stored in a register and can be displayed on the liquid crystal display.

6. Programmable control circuit arrangement as in claim 1, wherein said switching means comprises means for switching between said first switching state and said second switching state under timing control determined only by said internal time clock pulse such that the time segments of continuous connection of said second bus structure to said internal control line means when said control circuit is in said second switching state have lengths less than a time required to transmit individual data words during data exchange between the computer and the at least one addressable memory when said control circuit is in the first switchable state.

7. Programmable control circuit arrangement as in claim 2, wherein said control circuit includes at least one buffer memory between said first and second bus structures, having an input coupled to said first bus structure and an output coupled to said second bus structure.

8. Programmable control circuit arrangement as in claim 2, wherein said control circuit further comprises means for performing parallel to serial conversion of data words intended for transmission to the liquid crystal display while said control circuit is not in said second switching state.

9. Programmable control circuit arrangement as in claim 2, wherein said control circuit further comprises a multiplexer for switching said control circuit between said first switching state and said second switching state in response to said internal time clock pulse.

10. Programmable control circuit arrangement as in claim 2, wherein said control circuit further comprises internal registers coupled to said first bus structure for being accessed to by the computer for programming of operating states of said control circuit.

by control circuit 1 for assembling the display information from the data found in memories 6 and 7.

Controlled by the preferably quartz stable timer 12, 13, the pulse sequences required to build up the image display are generated in a fixed time pattern, with the image content being obtained from one of the two memories 6 or 7. Due to the fact that the two memory regions of the control unit are available with priority, difficulties resulting from possible collisions with computer access are avoided. The LCD displays the respective memory contents, with the type of display being actuated by an external instruction from the computer via bus structure 2 and the corresponding instructions being stored in a register 23. The storage of instructions in register 23 may occur at any time independently of the state of image generation, if only the type of image display is concerned. (The instructions which change the type of actuation of LCD 8 and practically assure adaptation to another LCD component group, can here be left out of consideration.)

If desired, both memories 6 and 7 may also be accessed twice in succession with respect to the same image content elements, with an arithmetic unit 24 generating logic linkages between these image contents so that a display dot is displayed in black if a corresponding display dot is controlled to be black in either of the two memories (OR-linked display) or only if both are controlled to be dark (AND); or it is possible to key the screen content to be dark only if one of the corresponding memory locations contains the information "black" (EXCLUSIVE-OR or EX-OR display). Memories 6 and 7 are here addressed in such a manner that successive memory addresses identify memory locations which are also successive in the image display. Corresponding memory addresses in memories 6 and 7 identify coinciding regions of the display. The data words stored in memories 6 and 7 describe—according to their bit length—the state of a corresponding sequence of display dots in LCD 8. Changes which relate to register 23 and which take place during build-up of the display, do not annoy the human viewer since—as long as the display information remains generally the same—this "change of displays" is observed as a natural change.

Due to the fact that the display information is obtained directly from memories 6 and 7—without the intermediary of character generators—the configuration of control circuit 1 is extremely simple. This does increase the amount of information required to be stored in memories 6 and 7 for assembly of a display. However, since the respective data can be stored and changed by the circuit according to the invention without any loss of time, the use of character generators within control circuit 1 would not result in simplification. Yet, the directly effective direct access to memories 6 and 7, as will be described below, considerably increases the universality of use of the control circuit.

If the data read out of memories 6 and 7 by means of bus structure 5 are used and transmitted—possibly after an arithmetic operation in component group 24 in a parallel/serial converter 15—each data word is transmitted in the rhythm of timer 12 as a bit pulse sequence to a corresponding data line leading to driver circuit 9. For reasons of simplicity, FIG. 3 shows only one data line. For the simultaneous actuation of a plurality of separate display regions, the parallel/serial converter 15 would correspondingly be provided several times.

Within the time cycle generated by the timer, internal control member 22 and the timer contained therein generate one pulse for each data word to be transmitted so as to set the data transmission in multiplexer 21 in such a manner that the internal bus lines are connected with external bus 5. By simultaneously addressing the respective memory region 6 or 7 (in dependence on a data word contained in register 23) the contents of the memory is transferred to parallel/serial converter 15 and, after the clock pulse signal has been delayed by a delay circuit 26 by a short period of time, readout of this data word from the parallel/serial converter is effected by way of a data line leading to driver circuit 9. While parallel/serial converter 15 is still reading out the data word, a further delay circuit 27 switches multiplexer 21 back in the direction of data traffic between bus structures 2 and 5.

In the illustrated block circuit diagram, delay lines 26 and 27 have merely symbolic significance. The respective signal delays can also be produced in a different way, for example by means of counters, natural line delays during signal transmission, etc.

Due to the fact that the access times during parallel/serial conversion for transmission of a data word to the LCD unit are relatively short, the computer connected to bus structure 2 is able to access memories 6 and 7 almost without restrictions.

Thus, memory regions 6 and 7 are available directly for the connected computer circuit and control circuit 1 is "quasi transparent". During access for actuation of the LCD, the data stored in memories 6 or 7 can be changed or erased. To obtain a constant image display, a complete change of displays is made without interruption. While access by the computer to one of memory regions 6 or 7 causes the information of a complete image display to be changed, a still picture can be displayed from the other memory region with the required "refresher" cycles, without being influenced by the change in images. In a preferred use of the invention, finished display contents are stored in main memory 4 (FIG. 1) in the correct sequence with respect to their addresses to be quickly transferred, if required, to a memory 6 or 7 associated with the LCD. All information elements serving to form a character are available in main memory 4 and can be addressed as units by means of macros and transferred into the corresponding memory regions of memories 6 and 7. This provides high flexibility, since fixed character rasters etc. are not required. The LCD can be operated in an independent mode capable of producing graphics, with complex characters, such as letters and numbers, etc., being quickly written in by the appropriate transfer of data.

If memory regions 6 or 7 do not correspond precisely to the memory requirement of the LCD element and—as in the normal case—slightly exceed its capacity, the excess memory locations can also be used by the computer as a memory region available in quasi direct access. Memory regions 6 and 7 can also be addressed by external component groups operating in the DMA mode since corresponding control lines ("ready") are available.

The data buffer 22 takes care that the data are readily available for access via bus structure 2 even if multiplexer 21 has already taken on its operational state for transmission of data in internal control member 25. Correspondingly, data can be read into the buffer region if the multiplexer is busy transmitting data from memories 6 and 7 to LCD 8. For example, in an embodiment which has been reduced to practice, in the readout mode a corresponding clock pulse cycle transfers 11. Programmable control circuit arrangement as in claim 2, wherein said control circuit further comprises control (ready) lines which allow DMA-capable components direct access to said second bus structure for exchange of data with the liquid crystal display.

12. Programmable control circuit arrangement as in claim 2, wherein said control circuit further comprises driver stages, said control circuit controlling the liquid crystal display through said driver stages.

13. Programmable control circuit arrangement as in claim 1, wherein said control circuit includes at least one buffer memory between said first and second bus structures, having an input coupled to said first bus structure and an output coupled to said second bus structure.

14. Programmable control circuit arrangement as in claim 1, wherein said control circuit further comprises means for performing parallel to serial conversion of data words intended for transmission to the liquid crystal display while said control circuit is not in said second switching state.

15. Programmable control circuit arrangement as in claim 1, wherein said control circuit further comprises a multiplexer for switching said control circuit between said first switching state and said second switching state in response to said internal time clock pulse.

16. Programmable control circuit arrangement as in claim 1, wherein said control circuit further comprises internal registers coupled said first bus for being accessed to by the computer for programming of operating states of said control circuit.

17. Programmable control circuit arrangement as in claim 1, wherein said control circuit further comprises control (ready) lines which allow DMA-capable components direct access to said second bus structure for exchange of data with the liquid crystal display.

18. Programmable control circuit arrangement according to claim 1, characterized in that various memory regions associated with the liquid crystal display can be reached under identical addresses, with the selection being effected by way of said control lines of said first bus structure.

19. Programmable control circuit according to claim 1, characterized in that various memory regions associated with the liquid crystal display can be logically linked by means of data words that can be stored in a register; storage of the corresponding data word indicating this state causing the individual display data to be displayed corresponding to the result of the logic linkage of the memory contents of corresponding display dots.

20. Programmable control circuit arrangement as in claim 1, wherein said pulse producing means is coupled to said switching means and said switching means comprises means, responsive only to said internal time clock pulse, for switching between said first switching state and said second switching state.

21. Programmable control circuit arrangement as in claim 2, wherein said pulse producing means is coupled to said switching means and said switching means comprises means, responsive only to said internal time clock pulse, for switching between said first switching state and said second switching state.

22. Programmable control circuit arrangement as in claim 21, wherein said means for switching comprises means for switching between said first switching state and said second switching state under timing control determined only by said internal time clock pulse such that the time segments of continuous connection of said second bus structure to said internal control line means have lengths less than the time require to transmit individual data words during the data exchange between the computer and the at least one addressable memory.

* * * * *

UNITED STATES PATENT AND TRADEMARK OFFICE

CERTIFICATE OF CORRECTION

PATENT NO. : 4,839,638

DATED : June 13th, 1989

INVENTOR(S) : Manfred Koslar et al

It is certified that error appears in the above-identified patent and that said Letters Patent is hereby corrected as shown below:

In the heading of the patent, under [75], the first inventor's name should read --Manfred Koslar--; and under [73], the Assignee should read --Createc Gesellschaft für Elektrotechnik mbH--.

Signed and Sealed this

Thirteenth Day of March, 1990

*Attest:*

JEFFREY M. SAMUELS

*Attesting Officer*

*Acting Commissioner of Patents and Trademarks*